United States Patent [19]

Pries et al.

[11] 3,937,656

[45] Feb. 10, 1976

[54] SHED-TYPE ENCLOSURE AT THE COKE SIDE OF COKE OVENS

[75] Inventors: Erich Pries; Friedrich-Wilhelm Drebes, both of Bochum, Germany

[73] Assignee: Dr. C. Otto & Comp. G.m.b.H., Bochum, Germany

[22] Filed: May 31, 1974

[21] Appl. No.: 474,921

[30] Foreign Application Priority Data

June 1, 1973 Germany ..... 2327890

[52] U.S. Cl. ..... 202/262; 202/263; 55/385 R; 55/434; 55/466; 98/115 R

[51] Int. Cl.[2] ..... C10B 33/00; C10G 41/08

[58] Field of Search ..... 202/262, 263; 55/434, 466, 55/385; 98/115 R

[56] References Cited

UNITED STATES PATENTS

| | | | |
|---|---|---|---|
| 2,234,826 | 3/1941 | Koppers | 55/434 X |
| 2,246,349 | 6/1941 | Crum | 55/466 X |
| 3,716,457 | 2/1973 | Schon | 202/263 |
| 3,844,901 | 10/1974 | Roe et al. | 202/263 |

*Primary Examiner*—James H. Tayman, Jr.
*Attorney, Agent, or Firm*—Brown, Murray, Flick & Peckham

[57] ABSTRACT

An enclosure in the form of a shed is disposed to extend along the entire length of the battery of ovens at the coke discharge side thereof. The shed roof rises from the top of the ovens to a shed wall spaced outwardly from the ovens beyond a track for a quench car. The shed wall essentially supports the weight of the shed roof in a cantilever fashion. Within the shed a baffle plate, carried by the shed wall, extends in an upward direction toward the battery of coke ovens. A conveyor is carried by the shed wall along its length for conveying solid particles of coke dropping from the baffle plate onto the conveyor. The shed further includes a pipe for extracting smoke within the shed which occurs when hot coke is pressed out of an oven chamber. The smoke extraction pipe is carried in one embodiment by the shed roof vertically above the baffle plate, in a second embodiment, by the shed wall above the upper end of the baffle plate and in a third embodiment by the shed wall at the lower end of the baffle plate.

7 Claims, 4 Drawing Figures

SHED-TYPE ENCLOSURE AT THE COKE SIDE OF COKE OVENS

BACKGROUND OF THE INVENTION

This invention relates to an apparatus in the form of a shed which is disposed at the coke side of coke ovens and arranged to extend along the entire length of a battery of coke ovens. More particularly, the present invention relates to such a shed which includes a wall spaced outwardly beyond a track for a quenching car used to receive coke from the ovens and wherein the shed includes an extractor for removing smoke that occurs when coke is pushed from an oven chamber into the quenching car.

As is known, hot coke is pressed out of a chamber of a coke oven into a quenching car adapted to move along a battery of such coke ovens. When the hot coke comes into contact with the air outside the ovens, vigorous combustion takes place. Highly buoyant gases are given off and entrained therein are large amounts of coke particles which are responsible for considerable environmental pollution. The prior art contains numerous suggestions of hoods, protective roof and other similar structures allegedly useful to alleviate or at least limit such pollution. Devices of this kind are not only costly but often have a limited effect for the intended purpose.

It has been suggested that a roof should be provided for a battery of coke ovens along the entire length thereof wherein the roof is made up of a horizontal portion and a downwardly-sloping portion toward the area outwardly beyond the oven chambers. This roof extends from the oven chamber doors as far as a longitudinal wall and covers the quenching car track. Inside the space covered by the roof, there is a perforated gas extractor pipe that extends along the entire length of the battery of oven chambers. The pipe is employed to extract gases and dust into a chimney of a quenching tower. The extent to which fans can be employed to extract gases from the space enclosed by the roof is limited. Workmen are needed to work within the area below the roof. The extraction process is insufficient to remove the relatively heavy coke particles entrained in the rising smoke and gases by the use of the extraction pipe. The buoyancy of the gases associated with the abrupt combustion does initially hurl the heavier coke particles upwardly but these particles usually bounce against the roof surface and then drop. Consequently, workmen while performing their necessary duties under this type of roof experience a continuous rain of coke particles. This is an unsatisfactory condition for the workmen to perform duties over a long period of time.

SUMMARY OF THE INVENTION

It is an object of the present invention to provide a shed-type enclosure at the coke side of coke ovens in such a manner that moderately operated fans can be effectively employed for extracting gases within the shed to prevent contamination of the environment and in a manner which is sufficient to enable workmen to safely remain within the area enclosed by the shed.

According to the present invention, there is provided in combination with the battery of coke ovens having a coke discharge side at which a track extends along the battery of coke ovens for the displacement of a quenching car to receive coke pushed from a chamber of the ovens, a shed at the coke discharge side of the ovens comprising a wall extending along the length of the battery of coke ovens and spaced outwardly therefrom beyond the track for the quenching car, a roof rising from the top of the coke ovens and extending above the track to the wall, and extractor means for removing smoke from the area below the roof.

Acccording to the invention, the roof forming part of the shed rises continuously from the top of the oven to the shed wall, the latter being arranged to extend along the quenching car track. Preferably, the shed roof is a rigid cantilever structure whereby its weight is borne mainly by the shed wall which is a lattice girder construction. The roof rises from the coke oven at an angle of approximately 45° and can be either a concave or convex construction. The actual covering of the roof is reinforced by a latticework. When solid particles of coke carried upwardly by the gases strike the upwardly inclined surface of the roof, the coke particles bounce off the roof and according to the laws of reflection are deflected toward the outer longitudinal wall where they drop out of the stream of gases.

According to another feature of the present invention, the aforesaid wall of the shed is provided with a baffle plate which rises in an inclined manner upwardly and forms a receiving channel extending along the entire length of the battery of coke ovens. The channel formed by the baffle plate improves the interception of coke particles dropping within the shed. A conveyor belt is arranged to extend in the channel along the length of the battery of coke ovens near the bottom of the baffle plate. The conveyor belt receives the coke particles that fall onto it and conducts the particles to an intermediate store area or some other place where the accumulated coke particles, dust and the like are added, for example, to the charge of coke in the quenching car.

The means for extracting the smoke evolving when the hot coke is pressed out of an oven chamber can be disposed either at the highest part of the shed near the outer closure wall or on the wall but near the bottom end of the baffle plate.

These features and advantages of the present invention as well as others will be more readily understood when the following description is read in light of the accompanying drawings, in which.

Figure 2:
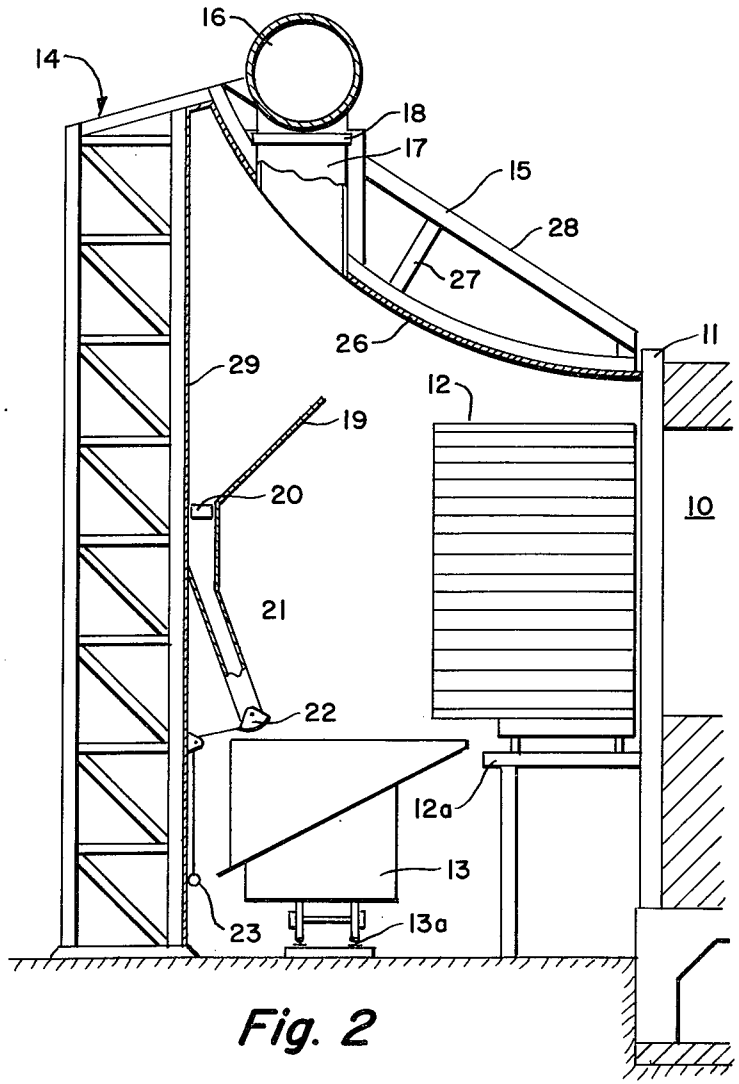
FIG. 2 is a view similar to FIG. 1 but illustrating a shed according to a second embodiment of the present invention.
Figure 1:
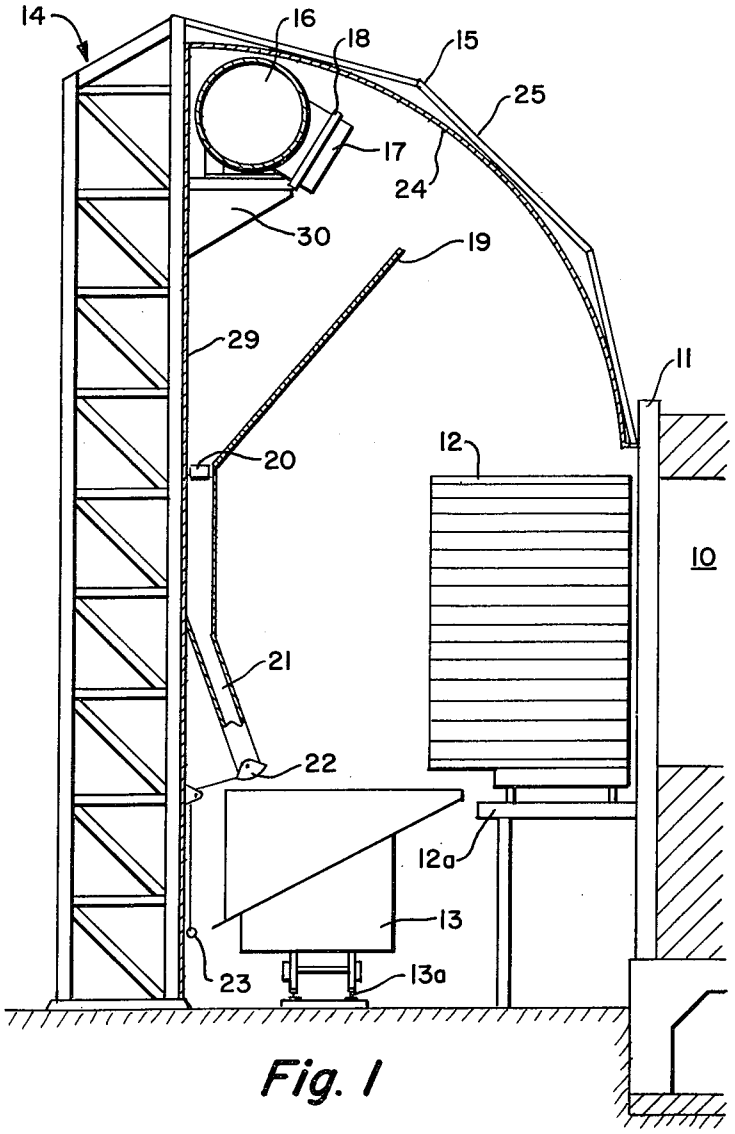
FIG. 1 is an elevational view, in section, of a shed at the coke discharge side of a coke oven according to one embodiment of the present invention.
Figure 3:
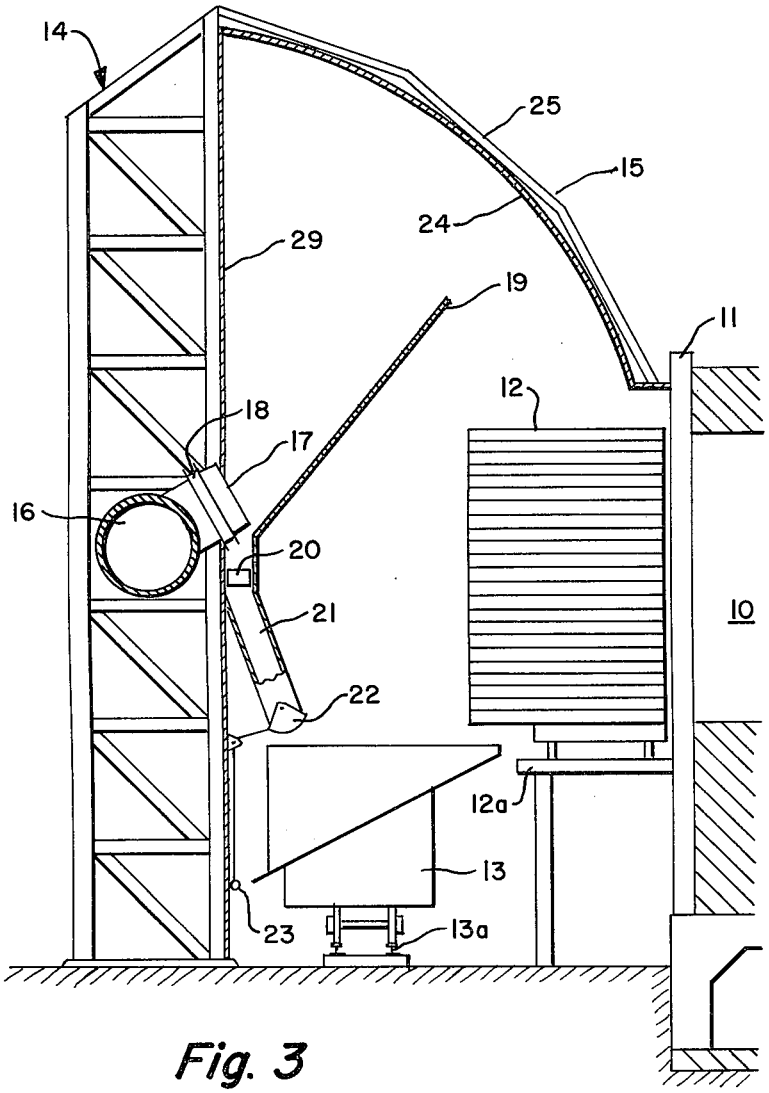
FIG. 3 is a view similar to FIG. 1 but illustrating a shed according to a third embodiment of the present invention.

The end portion of a coke oven chamber 10 is illustrated in FIGS. 1–3 which forms part of a battery of coke ovens that are per se, well known in the art. Buckstays 11 support the masonry forming the oven chambers. A coke guide grating 12 is supported on a wheeled car movable along rails carried by a platform 12A at the coke discharge side of the oven chambers. The guide grating is thus movable into alignment with a coke oven chamber for guiding the coke into a coke quenching car 13. The car 13 is moved slowly along rails 13A while the coke is being discharged from an oven chamber so as to spread the discharged coke into a uniform layer within the car. As the hot coke drops into the car, the air which comes into contact with the coke causes a considerable evolution of smoke. When this occurs, the particles of coke are hurled in an upward direction.

The rails 13A are spaced outwardly beyond the platform 12A for the guide grating and extend along the discharge side of the battery of coke ovens. Spaced outwardly beyond the rails 13A is a lattice girder structure 14 which rises vertically from ground level. Suspended from the structure 14 is a wall 29 preferably in the form of a metal plate. The girder structure 14 sustains most of the weight of a shed roof 15 which extends from the wall 29 to the top edge of the coke ovens. As clearly illustrated in FIGS. 1–3, in each embodiment the shed roof rises vertically from the top edge of the coke ovens at the coke discharge side thereof. The roof can be constructed in various forms. In FIGS. 1 and 3, a convex metal roof plate 24 is retained by lattice girders 25 disposed in a contiguous end-to-end angled relationship. In FIG. 3, a concave roof plate 26 is supported by inclined struts 27 and arms 28.

In each embodiment of the present invention, a baffle plate 19 is secured along its lower edge of the wall 29 for support by the lattice girders 14 at approximately the mid-height of the wall. The baffle plate extends outwardly from the wall a short distance from where it rises vertically and then the baffle plate extends in an inclined manner in the general direction toward the coke ovens and away from the wall 29. The larger coke particles which strike the interior surface of the roof and which are not removed with the extracted gases and smoke, are deflected at impact with the roof toward the wall 29. The particles drop into the channel or trough which is bounded by the baffle plate 19 and wall 29. At the bottom of the trough, a scraper conveyor 20 extends along the channel.

Figure 4:
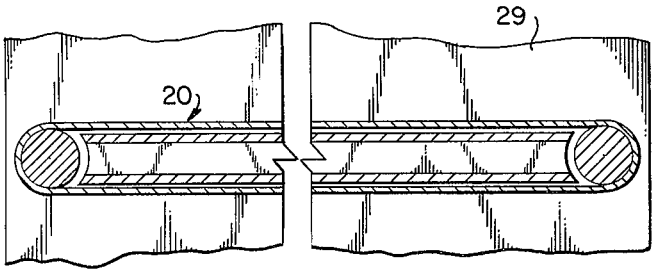
FIG. 4 is a longitudinal section through a typical conveyor employed in the shed of the present invention.

Chutes 21 are closed at their bottom discharge ends by hinged flaps 22. The flaps 22 are controlled by means of a gripper handle 23 attached by a chain or table to the flaps. FIG. 4 illustrates a typical form of a well-known type of conveyor having an endless belt or an endless chain with flight attachments to transport coke particles to one end of the shed. The chutes 21 are located at spaced locations along the length of the channel. In an alternative manner, the scraper chain can extend along the entire length of the battery of coke ovens. While not shown in the drawings, an ejection station for the coke particles that are carried by the conveyor, can be conveniently located near the quenching tower.

In each of the embodiments illustrated in FIGS. 1–3, the gases and smoke evolving during the pushing of coke from an oven chamber are extracted through a pipe 16 which conducts them to a remote station where dust particles are removed from the gases. The pipe 16 has an inlet 17 which can be automatically regulated by a control element 18. In FIG. 1, the extraction pipe 16 is supported by brackets 30 that are, in turn, carried by the girders 14. It will be observed that in regard to FIG. 1, the inlet 17 is disposed above the upper terminal edge of the baffle plate 19. In FIG. 2, the pipe 16 extends along the roof of the shed and has its inlet 17 opening out of the roof at a location vertically above the upper terminal edge of the baffle plate 19. In FIG. 3, the extraction pipe 16 extends within the space between the girders 14. The inlet 17 opens out of the wall 29 at an elevation just above the bottom of the channel bounded by the baffle plate 19.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In combination with a battery of coke ovens having a coke discharge side at which a track extends along said battery of coke ovens for the displacement of a quench car to receive coke pushed from a chamber forming said ovens, a shed at the coke discharge side of said ovens comprising: a wall extending along the entire length of said battery of coke ovens and spaced outwardly therefrom beyond said track, a roof rising from the top of said coke ovens, said roof extending above said track to said wall, extractor means for removing smoke from the area below said roof, a baffle plate extending from said wall in a direction upwardly and toward said battery of coke ovens within said shed, and a conveyor extending in a direction along the length of said battery of coke ovens, said conveyor lying between said baffle plate and said wall for receiving solid particles of coke falling onto the baffle plate within said shed.

2. The combination according to claim 1 wherein said wall includes lattice support girders for essentially carrying the weight of said roof whereby said roof extends in a cantilever manner from said wall.

3. The combination according to claim 1 wherein said conveyor is further defined to include a belt conveyor located between said wall and said baffle plate for extending along the length of said battery of coke ovens.

4. The combination according to claim 1 wherein said extractor means is carried by said wall within said shed at the lower end of said baffle plate.

5. The combination according to claim 1 wherein said extractor means is carried by said roof within said shed above the upper terminal edge of said baffle plate.

6. The combination according to claim 1 wherein said extractor means is carried by said wall within said shed vertically above the upper terminal edge of said baffle plate.

7. The combination according to claim 1 wherein said roof slopes upwardly from the top of said coke ovens at an angle of approximately 45°.

* * * * *